US008220402B2

(12) United States Patent
Ukai et al.

(10) Patent No.: US 8,220,402 B2
(45) Date of Patent: Jul. 17, 2012

(54) SEWING MACHINE AND COMPUTER READABLE MEDIUM STORING A FASTENING STITCH PROCESSING PROGRAM

(75) Inventors: Akie Ukai, Nagoy (JP); Masaki Shimizu, Toyoake (JP); Hirokazu Hirose, Chiryu (JP); Yoshinori Nakamura, Toyohashi (JP); Yoshio Nishimura, Nagoya (JP); Satoru Makino, Nagoya (JP); Kazumi Sai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 946 days.

(21) Appl. No.: 12/285,765

(22) Filed: Oct. 14, 2008

(65) Prior Publication Data

US 2009/0107374 A1 Apr. 30, 2009

(30) Foreign Application Priority Data

Oct. 24, 2007 (JP) ..... 2007-276523

(51) Int. Cl.
*D05B 21/00* (2006.01)

(52) U.S. Cl. ..... 112/102.5; 112/470.06; 700/136

(58) Field of Classification Search ..... 112/102.5, 112/470.01, 470.06, 475.05, 475.19; 700/136–138
See application file for complete search history.

(56) References Cited

U.S. PATENT DOCUMENTS

| | | | | |
|---|---|---|---|---|
| 4,532,876 | A | 8/1985 | Kongoh et al. | |
| 5,027,734 | A | 7/1991 | Horie et al. | |
| 5,826,526 | A * | 10/1998 | Tomita | 112/102.5 |
| 7,620,472 | B2 * | 11/2009 | Hamajima | 700/136 |
| 7,980,188 | B2 * | 7/2011 | Shimizu | 700/136 |
| 2007/0227419 | A1 | 10/2007 | Hirose | |
| 2007/0272135 | A1 | 11/2007 | Fujihara | |

FOREIGN PATENT DOCUMENTS

| | | |
|---|---|---|
| JP | A-59-211480 | 11/1984 |
| JP | A-3-139388 | 6/1991 |
| JP | A-3-143470 | 6/1991 |
| JP | A-6-142353 | 5/1994 |
| JP | A-6-218164 | 8/1994 |
| JP | A-6-218165 | 8/1994 |
| JP | A-2006-20757 | 1/2006 |
| JP | A-2007-244721 | 9/2007 |
| JP | A-2007-312897 | 12/2007 |

* cited by examiner

*Primary Examiner* — Nathan Durham
(74) *Attorney, Agent, or Firm* — Oliff & Berridge, PLC

(57) ABSTRACT

A sewing machine capable of mode switching between a normal sewing mode and a free motion sewing mode including a feed dog switcher that switches a feed dog between an active state in which the feed dog is moved above and below a needle plate and an inactive state in which the feed dog is lowered below the needle plate, a first instruction issuer that instructs execution of fastening stitching at a beginning of pattern sewing sequence, a second instruction issuer that instructs execution of fastening stitching at an end of pattern sewing sequence, and a controller that, when in the free motion sewing mode, activates the feed dog by the feed dog switcher in response to an incoming instruction signal from the first or the second instruction issuer to execute fastening stitching through control of feed dog based on fastening stitching data to longitudinally feed a workpiece cloth.

16 Claims, 12 Drawing Sheets

SEWING MACHINE AND COMPUTER READABLE MEDIUM STORING A FASTENING STITCH PROCESSING PROGRAM

CROSS-REFERENCE TO RELATED APPLICATIONS

This application is based upon and claims the benefit of priority from the prior Japanese Patent Application 2007-276523, filed on Oct. 24, 2007, the entire contents of which are incorporated herein by reference.

FIELD

The present disclosure relates to a sewing machine capable of mode switching between a normal sewing mode and free motion sewing mode. The present disclosure also relates to a computer readable medium storing a fastening stitch processing program to realize the above described features.

BACKGROUND

Conventionally, during a sewing operation, so called fastening stitches have been formed at the beginning and the end of pattern sewing sequence in order to prevent disintegration of seams formed on a workpiece cloth. The fastening stitches are formed in a predetermined stitch-pitch of approximately 0.2 mm, for a predetermined number of stitches of 3 or 4 stitches, for example.

One of such examples is given in JP H03-139388 A which discloses a data processor for an embroidery sewing machine including sewing data memory for storing enclosed area sewing data and a data-end detector that detects a starting end and a terminating end of the enclosed area sewing data stored in the sewing data memory.

The data processor stores fastening stitching data in a memory area immediately preceding the starting end of the enclosed area sewing data, and immediately following the terminating end of the enclosed area sewing data. During a normal sewing operation, by controlling the embroidery sewing machine based on the enclosed area sewing data and fastening stitching data, fastening stitches are formed at the starting end and the terminating end of the enclosed area of the embroidery pattern.

Household sewing machines conventionally allow execution of a normal sewing operation and a free motion sewing operation. Normal sewing operation is carried out by feeding a workpiece cloth by a feed dog which is moved above and below the upper surface of a needle plate provided on a sewing machine bed. Free motion sewing operation, on the other hand, allows the user to manually feed the workpiece cloth freely while preventing the feed dog to protrude above the upper surface of the needle plate. When executing the free motion sewing operation, a presser foot dedicated for free motion sewing operation is attached to a presser bar and the workpiece cloth placed on the upper surface of the sewing machine bed is manually moved along guidance provided by indicators as a baseline drawn prior to the sewing operation.

In free motion sewing operation where workpiece cloth is moved manually, fastening stitches also need to be formed manually. However, in order to form fastening stitches in a small stitch-pitch, the workpiece cloth needs to be moved little by little, which requires considerable technical maturity on the part of the user. Such being the case, it has been a difficult task for inexperienced users to form fastening stitches during a free motion sewing operation.

SUMMARY

An object of the present disclosure is to provide a sewing machine that allows fastening stitches to be readily formed at the beginning and the end of pattern sewing during a free motion sewing operation and a computer readable medium storing a fastening stitch processing program for realizing the above described features.

In one aspect, a sewing machine of the present disclosure includes a sewing machine bed, a needle plate provided on the sewing machine bed, a feed dog provided in the sewing machine bed below the needle plate, a needle bar, and a sewing needle attached to the lower end of the needle bar, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated in a lowered position below the needle plate to allow the workpiece cloth to be manually fed, the sewing machine including a feed dog driver that drives the feed dog longitudinally and vertically; a feed dog switcher that activates and inactivates the feed dog; a first instruction issuer that instructs execution of fastening stitching at a beginning of pattern sewing sequence; a second instruction issuer that instructs execution of fastening stitching at an end of pattern sewing sequence; a fastening stitching data storage that stores fastening stitching data for executing fastening stitching on the workpiece cloth being fed longitudinally by the feed dog; and a controller that, when in the free motion sewing mode, activates the feed dog by the feed dog switcher in response to an incoming instruction signal from the first instruction issuer or the second instruction issuer to execute fastening stitching through control of feed dog driver based on the fastening stitching data.

The sewing machine according to the above described configuration activates the feed dog by the feed dog switcher when fastening stitching at the beginning of the sewing sequence is instructed by the first instruction issuer during the free motion sewing mode. Feed dog driver is also driven through control of the controller based on the fastening stitching data stored in the fastening stitching data storage to execute fastening stitching. Fastening stitching is thus automatically executed at the beginning of the pattern sewing sequence on the workpiece cloth. A sewing operation under the free motion sewing mode is executed with the feed dog being inactivated by the feed dog switcher.

When fastening stitching at the end of a sewing sequence is instructed by the second instruction issuer, on the other hand, the feed dog is similarly switched to the active state by the feed dog switcher and the feed dog driver is driven through control of controller to execute fastening stitching. Fastening stitching is thus automatically executed at the end of the pattern sewing sequence on the workpiece cloth. The above described configuration allows fastening stitches to be formed on the workpiece cloth at the beginning and the end of a sewing sequence. Since the user need not feed the workpiece cloth manually in small amounts, even an inexperienced user can readily execute fastening stitching.

In another aspect, a sewing machine of the present disclosure includes a sewing machine bed, a needle plate provided on the sewing machine bed, a feed dog provided in the sewing machine bed below the needle plate, a needle bar, and a sewing needle attached to the lower end of the needle bar, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated in a lowered position below the needle plate to allow the workpiece cloth to be manually fed, the sewing machine including a needle bar swinger that laterally swings the needle bar; a feed dog switcher that activates and inactivates the feed dog; a first instruction issuer that instructs execution of fastening stitching at a beginning of pattern sewing sequence; a second instruction issuer that instructs execution of fasting stitching at an end of pattern sewing sequence; a fastening stitching data storage that stores fastening stitching data for executing fastening stitching on the workpiece cloth by laterally swinging the needle bar; and a controller that, when in the free motion sewing mode, executes fastening stitching in response to an incoming instruction signal from the first instruction issuer or the second instruction issuer to execute fastening stitching through control of needle bar swinger based on the fastening stitching data.

In the sewing machine according to the above described configuration, a sewing operation under the free motion sewing mode is executed with the feed dog being inactivated by the feed dog switcher. When fastening stitching at the beginning of a sewing sequence is instructed by the first instruction issuer, the needle bar swinger is driven through control of controller based on the fastening stitching data stored in the fastening stitching data storage to execute fastening stitching by laterally swinging the needle bar. Fastening stitching is thus automatically executed at the beginning of the pattern sewing sequence on the workpiece cloth.

When fastening stitching at the end of a sewing sequence is instructed by the second instruction issuer, on the other hand, the needle bar swinger is driven through control of controller based on the fastening stitching data stored in the fastening stitching data storage to execute fastening stitching. Fastening stitching is thus automatically executed at the end of the pattern sewing sequence on the workpiece cloth. The above described configuration allows fastening stitches to be formed on the workpiece cloth at the beginning and the end of a sewing sequence. Since the user need not feed the workpiece cloth manually in small amounts, even an inexperienced user can readily execute fastening stitching. Moreover, since fastening stitching is executed by the swinging of the needle bar without feeding the workpiece cloth, the feed dog no longer needs to be activated from the inactive state, which simplifies the overall sewing operation.

The sewing machine of the present disclosure may be further provided with a presser bar vertically moving mechanism that vertically moves the presser bar having a presser foot that presses the workpiece cloth against the needle plate. The controller may be configured to control the presser bar vertically moving mechanism to press the workpiece cloth with the presser foot when executing fastening stitching based on incoming instruction signal from the first instruction issuer and the second instruction issuer.

The above described configuration allows the workpiece cloth to be reliably pressed by the presser foot during fastening stitching, which in turn allows the workpiece cloth to be fed reliably by the feed dog or reliably prevent unnecessary movement of the workpiece cloth during fastening stitching. Moreover, since the user is not required to manually lower the presser foot, the above configuration does not affect work efficiency.

The sewing machine of the present disclosure may be further provided with a determiner that determines whether or not the subsequent operational state of the sewing machine is a start of sewing sequence. The controller may be configured to execute fastening stitching in response to the incoming instruction signal from the first instruction issuer provided that the start of a sewing sequence is determined as the subsequent operational state of the sewing machine by the determiner. By determining the start of a sewing sequence by the determiner, fastening stitches can be reliably formed at the beginning of a sewing sequence and prevent formation of unnecessary fastening stitches.

The determiner may be configured to determine the start of a sewing sequence when encountering either of a mode switching from the normal sewing mode to the free motion sewing mode, a detection of threading operation by the threading switch, a detection of lack of remaining bobbin thread amount by the bobbin thread sensor, and an execution of fastening stitching at the end of pattern sewing sequence of the workpiece cloth in response to incoming instruction signal from the second instruction issuer. The above described configuration, in which the operational status of the sewing machine is closely monitored, prevents unnecessary fastening stitches from being formed.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
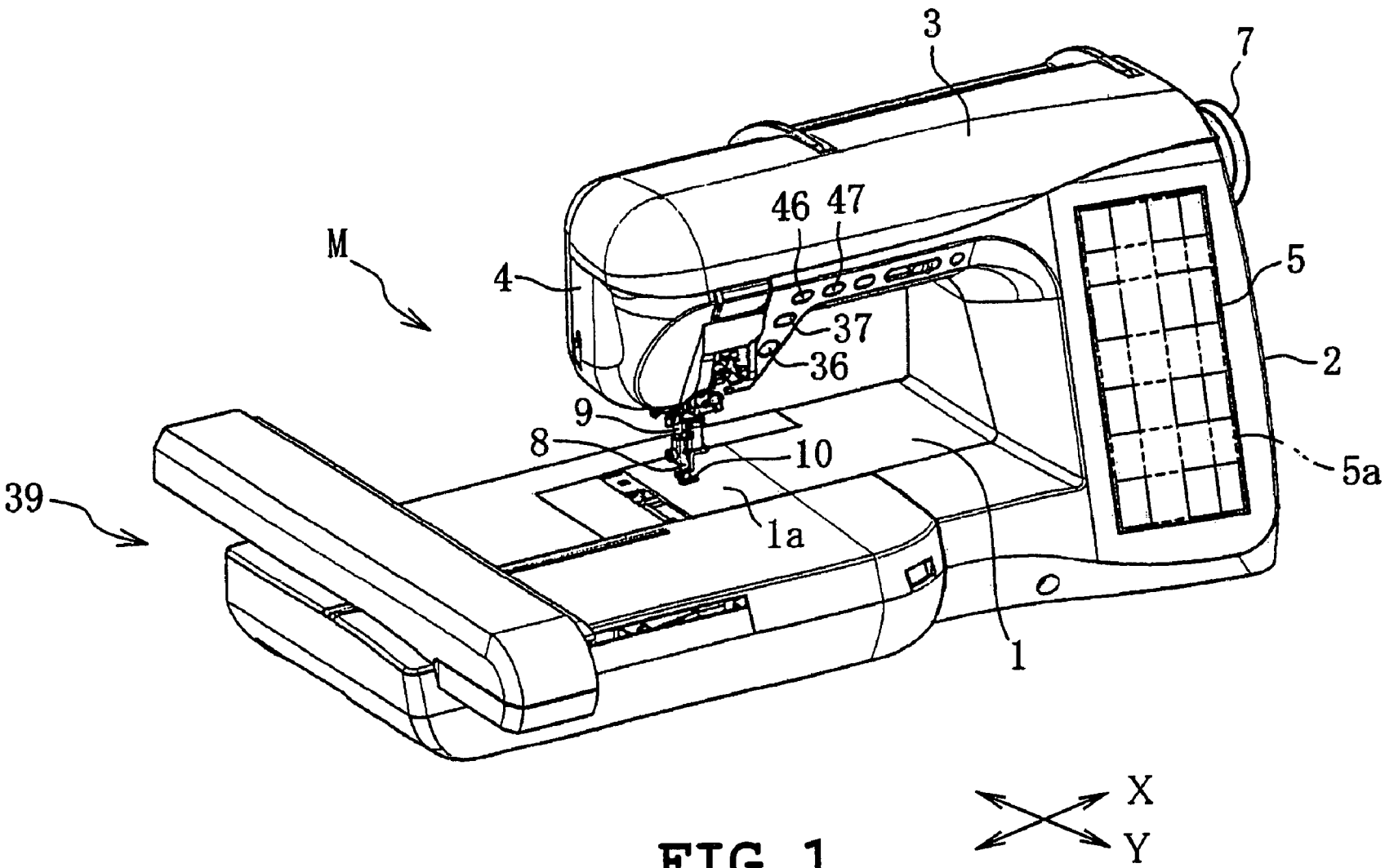
FIG. 1 is a perspective view of a sewing machine according to one exemplary embodiment of the present disclosure.

One exemplary embodiment employing the present disclosure to an embroidery sewing machine will be described with reference to FIGS. 1 to 12. Referring to FIG. 1, a sewing machine M includes a laterally extending (X-direction) sewing machine bed 1 (hereinafter referred to as bed 1), a pillar 2 extending upward at the right end of bed 1, and an arm 3 extending leftward over bed 1 from the upper end of pillar 2 as viewed in FIG. 1. Description will be given hereinafter with an assumption that the direction to which the user positions himself relative to sewing machine M is the front and the direction opposite the front is the rear. The side on which pillar 2 resides is the right side, and the opposite side, naturally, is the left side.

Figure 5:
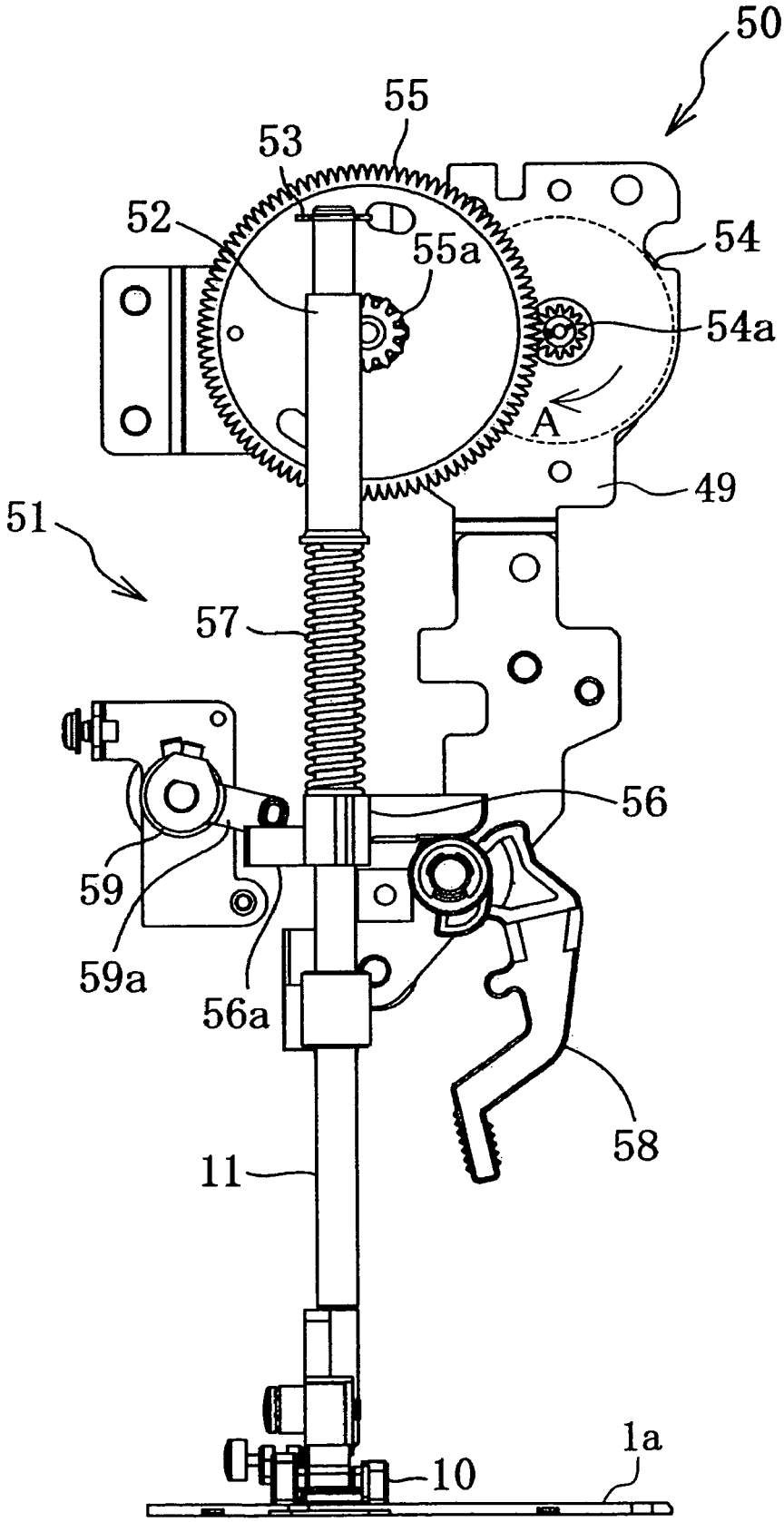
FIG. 5 is a front view of a presser bar vertically moving unit when a presser foot is in a pressing position.
Figure 6:
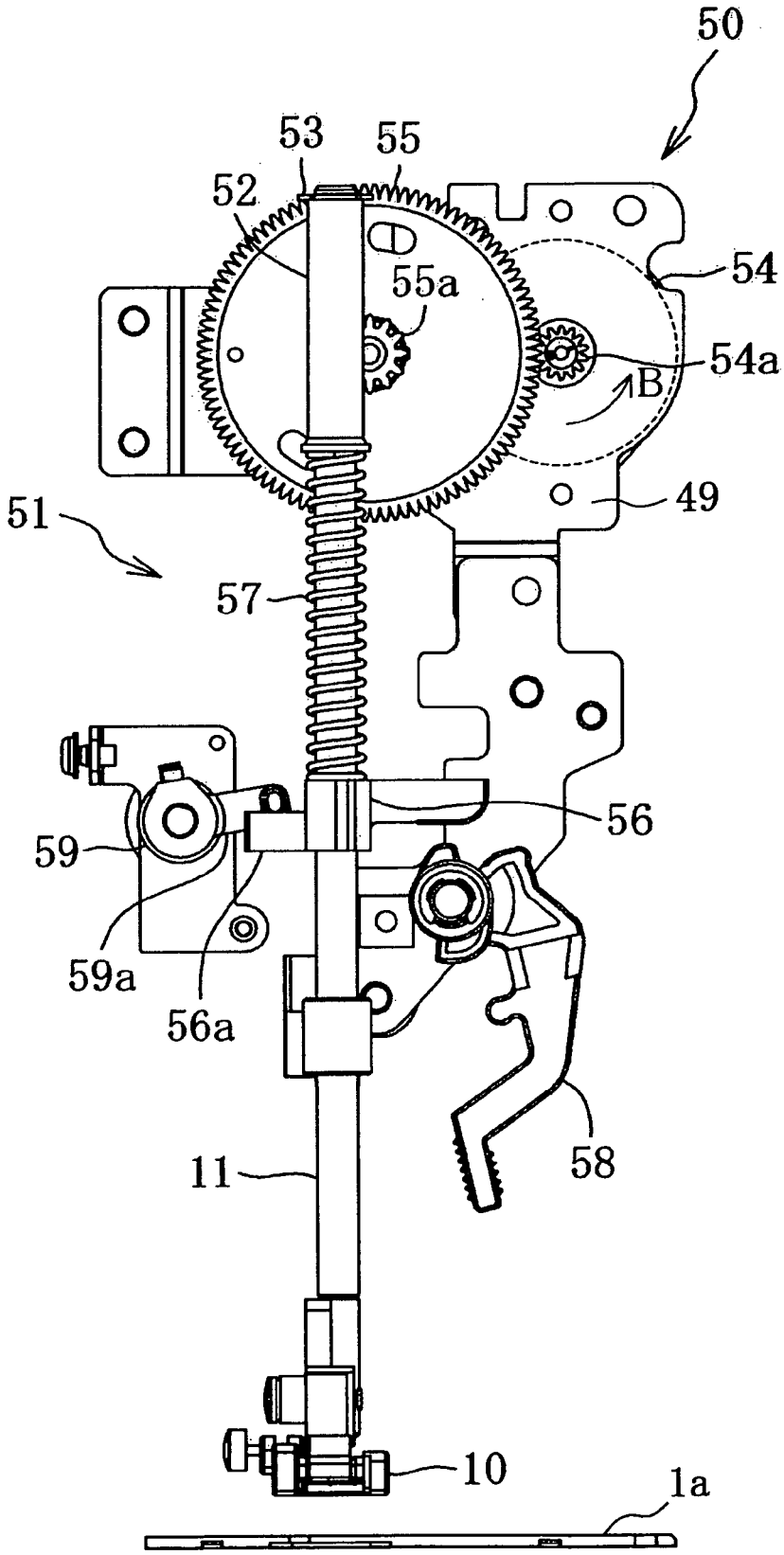
FIG. 6 is a front view of a presser bar vertically moving unit when a presser foot is in an elevated position.

On the extreme end of arm 3, a head 4 is defined that is provided with a needle bar 9 which is configured vertically movably and laterally (X-direction) swingably. At the lower end of needle bar 9, a sewing needle 8 is attachably/detachably (interchangably) attached. As can be seen in FIGS. 5 and 6, a presser foot 10 is provided at the rear side of needle bar 9 situated within head 4. Arm 3 includes a laterally extending main shaft (not shown) rotated by a sewing machine motor 6 (shown only in FIG. 9) and a hand pulley 7 allowing manual rotation of the main shaft.

Inside head 4, a vertically oriented elongate needle bar support 21 (refer to FIG. 3) is provided. The upper end of needle bar support 21 is swingably supported by a sewing machine frame. Needle bar 9 is mounted vertically movably on needle bar support 21. Further provided inside head 4 is a well known needle bar driving mechanism (not shown) that converts rotary movement of the main shaft into the vertical movement of needle bar 9, and as described afterwards, a needle bar swinging unit 20 (refer to FIG. 3) that swings needle bar 9 in a lateral direction (X-direction) orthogonal to the direction (Y-direction) of cloth feed in synchronism with the vertical movement of needle bar 9.

As will be described afterwards, head 4 further includes a needle threading mechanism 40 (refer to FIG. 4) for threading an eye of sewing needle 8 with a needle thread, a presser foot vertically moving unit 50 (refer to FIGS. 5 and 6) for vertically moving presser foot 10. Though not shown, head 4 is further provided with components such as a thread take-up driving mechanism that vertically drives a thread take-up (not shown) in synchronism with the vertical movement of needle bar 9, and a thread tension regulator for adjustment of needle thread tension.

Referring to FIG. 1, a needle plate 1*a* is provided on the upper surface of bed 1 so as to be situated in a position corresponding to needle bar 9. Needle plate 1*a* has a square hole (not shown) through which feed dog 18 (refer to FIGS. 7 and 8) is moved up and down to feed the workpiece cloth (not shown) in the longitudinal direction. Provided inside bed 1 is a laterally extending lower shaft 63 (refer to FIGS. 7 and 8) to which rotation of main shaft is transmitted through a transmission mechanism not shown. Lower shaft 63 rotates in synchronism in one to one relation with the main shaft. Lower shaft 63 drives a shuttle mechanism 12 and a feed dog driving unit described afterwards.

In the left side interior of bed 1 below needle plate 1*a*, shuttle mechanism 12 (refer to FIG. 2) and a feed dog driving unit (not shown) are provided. Shuttle mechanism 12 contains a bobbin thread bobbin 13 (refer to FIG. 2) and forms stitches on the workpiece cloth in cooperation with sewing needle 8. Feed dog driving unit (not shown), as well known in the art, drives feed dog 18 back and forth and up and down.

Though not shown, feed dog drive unit includes a feed dog vertically moving mechanism (not shown) for vertically moving feed dog 18, and a feed dog longitudinally moving mechanism (not shown) for longitudinally moving feed dog 18. Feed dog longitudinally moving mechanism is provided with a feed adjustment mechanism (not shown) that allows adjustment in amount of cloth feed produced by the feed dog longitudinally moving mechanism. The feed adjustment mechanism is driven by a feed adjustment step motor 19 (refer to FIG. 9) and allows adjustment in feed amount through user operation of a later described touch panel 5*a*. During fastening stitching, however, feed amount is set at approximately 0.2 mm.

As will be described in detail afterwards, bed 1 further contains a feed dog switching unit 60 (refer to FIGS. 7 and 8) that switches feed dog 18 between an active state and an inactive state, the active state allowing the workpiece cloth to be fed by moving feed dog 18 above and below needle plate 1*a*, and the inactive state prohibiting feeding of the workpiece cloth by feed dog 18 by lowering feed dog 18 below needle plate 1*a*. Bed 1 further contains a thread cut mechanism (not shown) that cuts the needle thread and the lower thread.

Referring again to FIG. 1, bed 1 has a free arm portion at its left end which allows detachable/attachable attachment of an embroidery unit 39 for forming embroidery patterns using an embroidery frame (not shown). Embroidery unit 39 drives the embroidery frame in an X-direction (lateral direction) and a Y-direction (longitudinal direction) independently. Sewing machine M is automatically set to embroidery sewing mode while embroidery unit 39 is attached to bed 1.

Though not shown, bed 1, when embroidery unit 39 is detached, may allow detachable/attachable attachment of an auxiliary table for increasing the area for workpiece cloth placement. In such case, sewing machine M with auxiliary table attachment executes normal sewing operation in which utility stitches such as straight stitches and zigzag stitches are formed while feeding the workpiece cloth with feed dog 18 and a free motion sewing operation in which stitches are formed while the workpiece cloth is manually moved stitch by stitch in given directions by the user.

On the front face of pillar 2 is provided a large liquid crystal display 5 (hereinafter simply referred to as color display 5) which is in turn provided with a touch panel 5*a* comprising matrix-aligned touch keys composed of transparent electrodes is provided for user operation on its surface. Touch panel a has a mode setting key 45 (refer to FIG. 9) to allow setting of modes such as a normal sewing mode, free motion sewing mode, and an embroidery sewing mode. Touch panel 5*a* further allows user operations such as a pattern selection and function setting.

On the front side of arm 3 shown in FIG. 1, various types of switches such as a start/stop switch 36, a fastening stitch switch 37, a reverse stitch switch 46, and thread cutting switch 47 are provided. Start/stop switch 36 instructs start/stop sewing operations as well as instructing formation of fastening stitches. Fastening stitch switch 37 instructs formation of fastening stitches at the end of sewing operations or on a required basis. Reverse stitch switch 46 instructs formation of reverse stitches, and a thread cutting switch 47 instructs cutting of sewing thread by a thread cut mechanism.

Next, a description will be given on a shuttle mechanism 12 with reference to FIG. 2.

Figure 2:
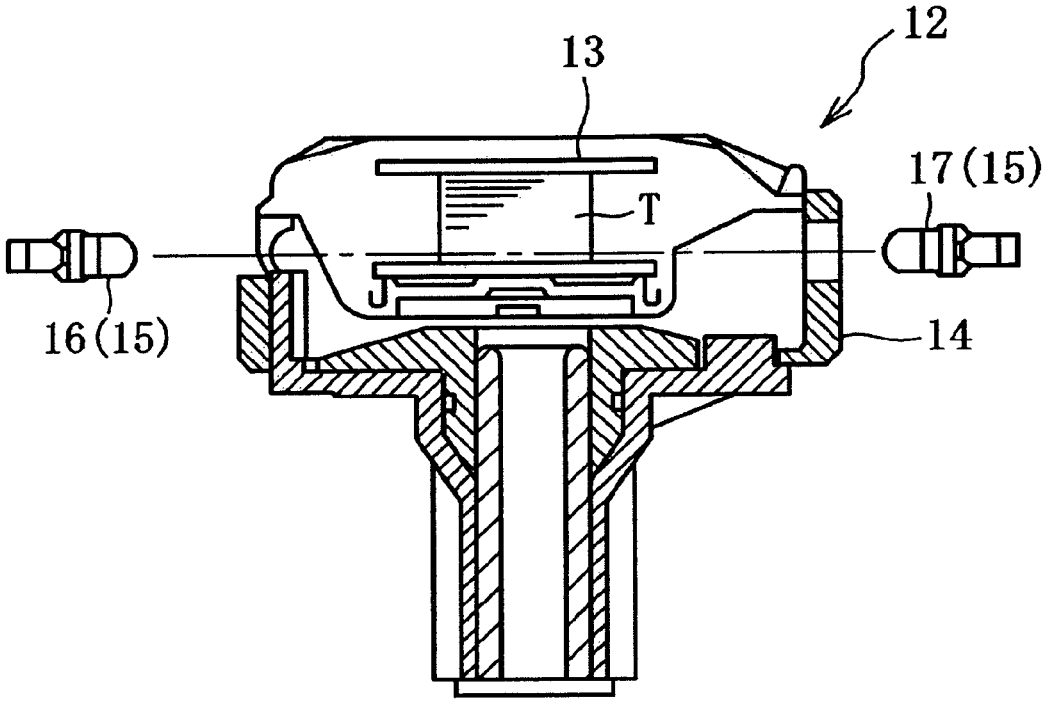
FIG. 2 is a vertical cross sectional view indicating a relative positioning of a bobbin thread bobbin to a bobbin thread sensor.

Referring to FIG. 2, shuttle mechanism 12 includes components such as a bobbin thread bobbin 13 being wound with a bobbin thread T, a horizontal shuttle 14 attachably/detachably containing bobbin thread bobbin 13, and a bobbin thread sensor 15 for sensing the remaining amount of bobbin thread T wound on bobbin thread bobbin 13. Bobbin thread sensor 15 comprises an optical sensor having a radiating section 16 and an incident section 17. Bobbin thread sensor 15 is configured so that when there is sufficient amount of remaining bobbin thread T wound on bobbin thread bobbin 13, irradiation from radiating section 16 is blocked by bobbin thread T and thus, is not sensed by incident section 17; whereas when amount of remaining bobbin thread T wound on bobbin thread bobbin 13 is insufficient, irradiation is sensed by incident section 17 (incident section 17 indicates an ON state).

Next, a description will be given on needle bar swinging mechanism 20 with reference to FIG. 3.

Figure 3:
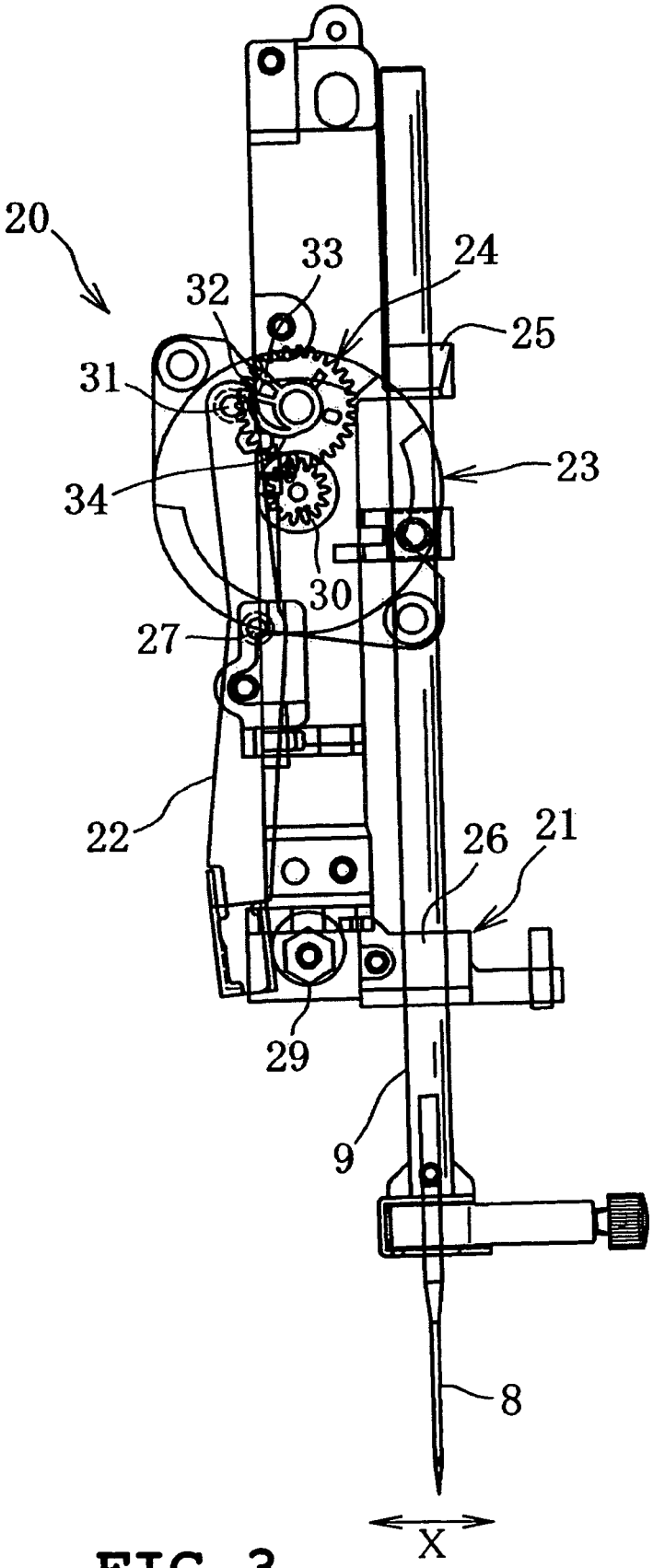
FIG. 3 is a front view of a needle bar swinging unit.

Referring to FIG. 3, needle bar swinging mechanism 20 includes components such as a needle bar support 21, a swing lever 22, a needle bar swinging step motor 23, and a swing cam 24. Needle bar support 21, being vertically elongate in form, is provided with an upper pivoting section 25 and a lower pivoting section 26 on its right side to support needle bar 9 vertically movably. Thus, lateral swinging of needle bar support 21 causes lateral swinging of needle bar 9.

Needle bar swinging step motor 23, being vertically elongate in form, is secured to the sewing machine frame and swing cam 24 is supported rotatably by the sewing machine frame. Needle bar swinging step motor 23 has a drive gear 30 mounted on its output shaft which is in mesh with a gear formed on the outer periphery of swing cam 24.

Swing lever 22 is swingably pivoted on sewing machine frame at its vertical mid portion by a pivot pin 27. The lower end of swing lever 22 abuts a cam body 29 secured on the lower end of needle bar support 21. The upper end of swing lever 22, on the other hand, has a pin 31 secured on it that abuts a cam surface 32 of swing cam 24. The lower end of needle bar support 21 is biased leftward by a coil spring not shown to maintain the respective abutments.

Cam surface 32 provided at swing cam 24 comprises a large-radius cam surface 33 and a small-radius cam surface 34 which are formed continuously. Small-radius cam surface 34 is situated closer to the rotational axis compared to large-radius cam surface 33. When swing cam 24 is rotated by needle bar swinging step motor 23 and large-diameter cam surface 33 relatively distanced from the rotational axis of swing cam 24 is placed in contact with a pin 31, the upper end of swing lever 22 is moved to the left, whereas the lower end of the swing lever 22 is moved to the right via a pivot pin 27, consequently moving needle bar support 21 to the right as well.

When swing cam 24 is rotated by needle bar swinging step motor 23 and small-diameter cam surface 34 situated relatively closer to the rotational axis of swing cam 24 is placed in contact with pin 31, the upper end of swing lever 22 is moved to the right, whereas the lower end of the swing lever 22 is moved to the left via pivot pin 27, consequently moving needle bar support 21 to the left as well.

Next, a description will be given on a threading mechanism 40 with reference to FIG. 4.

Figure 4:
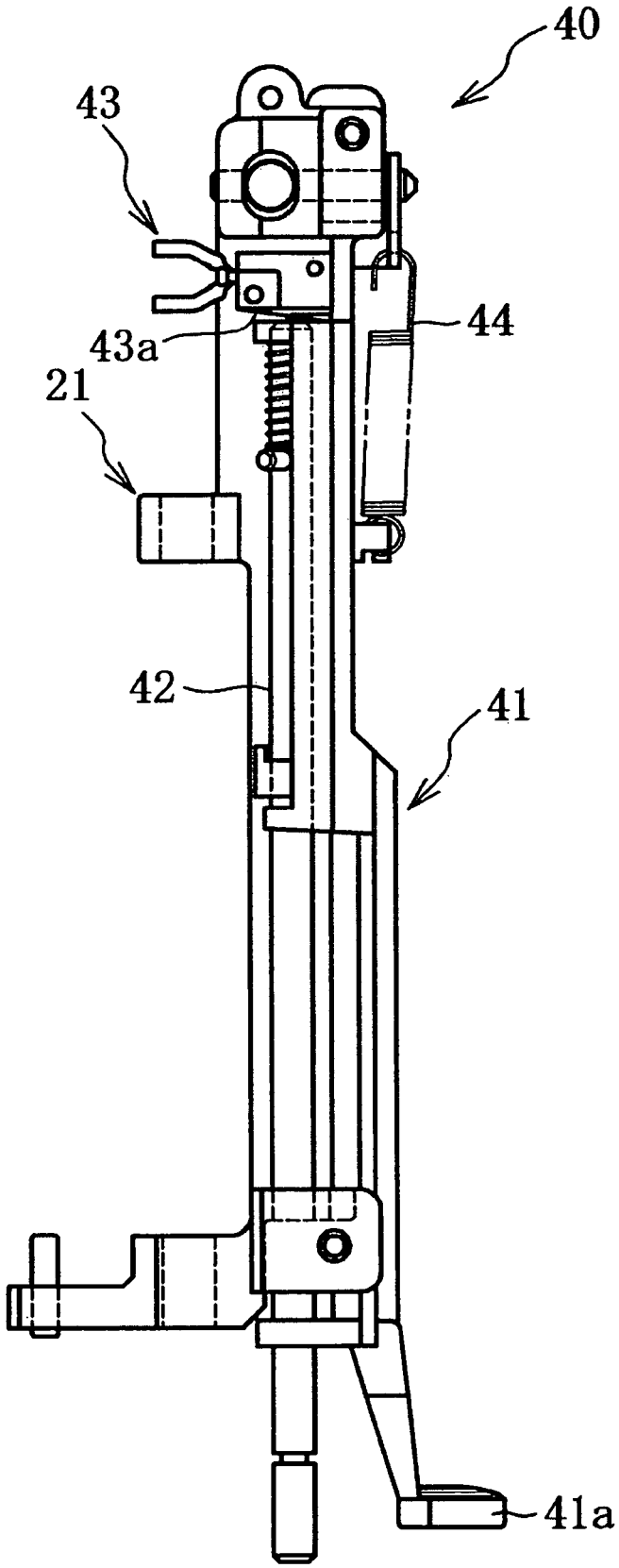
FIG. 4 is a rear view of a threading mechanism.

As can be seen in FIG. 4, threading mechanism 40 is configured as a generally known threading mechanism for threading a needle thread to an eye (not shown) of sewing needle 8 attached to the lower end of needle bar 9, and thus will not be described in detail. Threading mechanism 40 includes components such as needle bar support 21, a threading slider 41 provided vertically movably to needle bar support 21, a threading shaft 42, a hook (not shown) provided at the lower end of threading shaft 42, and a threading switch 43 for detecting whether or not a threading operation is being executed. Threading shaft 42 is supported vertically movably by needle bar support 21 and threading slider 41 is fitted over threading shaft 42. Between the upper end of threading slider 41 and the upper end of needle bar support 21, an extension coil spring 44 is engaged to exert upward bias on threading slider 41, thus, when threading slider 41 is inoperative, threading slider 41 and threading shaft 42 are constantly placed in an elevated standby position.

When threading the eye of sewing needle 8 with a needle thread, a handle 41*a* provided at threading slider 41 is lowered by the user to pass the hook through the eye of sewing needle 8. After the needle thread is seized by the hook under such state and the user releases the hold of handle 41*a*, the seized needle thread is passed through the eye of sewing needle 8 when the hook moves out of the eye of the sewing needle 8 and elevates to its original position.

On the rear upper portion of needle bar support 21, threading switch 43 is fastened by a screw not shown. Threading switch 43 is provided with a lever 43*a* which is pressed by the upper end of threading slider 41 when threading slider 41 is in an inoperative elevated position, in which state, lever 43*a* is turned OFF. When threading slider 41 is in the lowered position, on the other hand, the upper end of threading slider 41 is moved away from lever 43*a* of switch 43 to place lever 43*a* in an ON state.

Next, a description will be given on presser bar vertically moving unit 50 with reference to FIGS. 5 and 6.

Referring to FIGS. 5 and 6, presser bar 11 having a presser foot 10 attached to its lower end is disposed behind needle bar 9 and is supported vertically movably by the sewing machine frame. Presser bar vertically moving unit 50 includes a presser bar vertically moving mechanism 51 and presser bar driving step motor 54 serving as an actuator for driving presser bar vertically moving mechanism 51 and is mounted on a mount plate 49 secured on the sewing machine frame. Presser bar vertically moving unit 50 allows presser foot 10 and consequently presser bar 11 to be vertically moved between an elevated position elevated from needle plate 1*a* shown in FIG. 6 and pressed position in pressed contact with the upper surface of the workpiece cloth placed on needle plate 1*a* as shown in FIG. 5.

Presser bar vertically moving mechanism 51 is configured as follows. Presser bar 11 has a presser bar clamp 56 secured at its vertical mid portion. Presser bar 11 further has a spring 57 comprising a coil spring fitted over it at a portion above needle bar clamp 56 and a rack forming element 52 fitted vertically movably over it at a portion above spring 57. Finally a stop ring 53 is provided at the upper end of presser bar 11.

On the upper rear side of mount plate 49, presser bar driving step motor 54 is mounted so as to be oriented forward such that its output shaft penetrates to the front side of mount plate 49 and a drive gear 54*a* is attached on the output shaft so as to be situated on the front side of mount plate 49. On the front face of mount plate 49, a large-diameter intermediate gear 55 being rotated integrally with a coaxial small-diameter pinion 55*a* is provided such that intermediate gear 55 is in mesh with drive gear 54*a* and pinion 55*a* is in mesh with rack forming element 52. Mount plate 49 further has at the immediate right side of presser bar clamp 56, a presser foot lifting lever 58 for vertically moving presser bar 11 and consequently presser foot 10 by manual operation of the user.

At the immediate left side of presser bar 11, a potentiometer 59 is provided for detecting the height of presser bar clamp 56, and consequently presser foot 10. Potentiometer 59 has a lever 59*a* extending rightward from its rotary shaft that is placed in abutment with the upper surface of a protrusion 56*a* protruding leftward from presser bar clamp 56. Potentiometer 59 configured as described above swings to exert rotation of rotary shaft in response to the vertical movement of presser bar 11 and presser bar clamp 56 to alter its resistance. The height of presser foot 10 is calculated by a controller 91 (refer to FIG. 9) based on the altered resistance. The height of presser foot 10 is a measurement relative to a reference height in which the underside of presser foot 10 is placed in abutment with the upper surface of needle plate 1*a*. The thickness of the workpiece cloth can be detected by detecting the reference height of presser foot 10.

Presser bar driving step motor 54 is controlled by controller 91 (refer to FIG. 9) described afterwards and presser bar driving step motor 54 imparts its drive force to intermediate gear 55 and pinion 55*a* to cause the vertical movement of rack forming element 52.

More specifically, when drive gear 54*a* is rotated clockwise in the direction of arrow A as viewed in FIG. 6 with presser foot 10 in elevated position (refer to FIG. 6), for example, intermediate gear 55 is rotated counterclockwise to lower rack forming element 52. The lowering of rack forming element 52 causes presser bar 11 and consequently presser foot 10 to be lowered via spring 57. As presser bar 11 is lowered, the underside of the presser foot 10 contacts the workpiece cloth (not shown) placed on the upper surface of needle plate 1*a*. Further lowering of rack forming element 52 from this state causes compression of spring 57 as shown in FIG. 5 to exert a force on presser foot 10 to press the workpiece cloth.

On the other hand, when drive gear 54*a* is rotated counterclockwise by presser bar driving step motor 54 in the direction of arrow B as viewed in FIG. 6, intermediate gear 55 is rotated clockwise to elevate rack forming element 52. The upper end of rack forming element 52 is placed in abutment with stop ring 53 secured on the upper end of presser bar 11. Thus, as can be seen in FIG. 6, elevation of rack forming element 52 causes elevation of presser bar 11 and consequently presser foot 10 to their elevated position.

As described above, during the free motion sewing operation, controller 91 controls presser bar vertically moving unit 50 to lift presser foot 10 to an elevated position which is spaced from the workpiece cloth by a predetermined small spacing of 1 mm, for example, as shown in FIG. 6; whereas during fastening stitching, presser foot 10 is lowered to a pressing position to press the workpiece cloth as shown in FIG. 5.

Next, a brief description will be given on feed dog switching unit 60 with reference to FIGS. 7 to 8.

Figure 7:
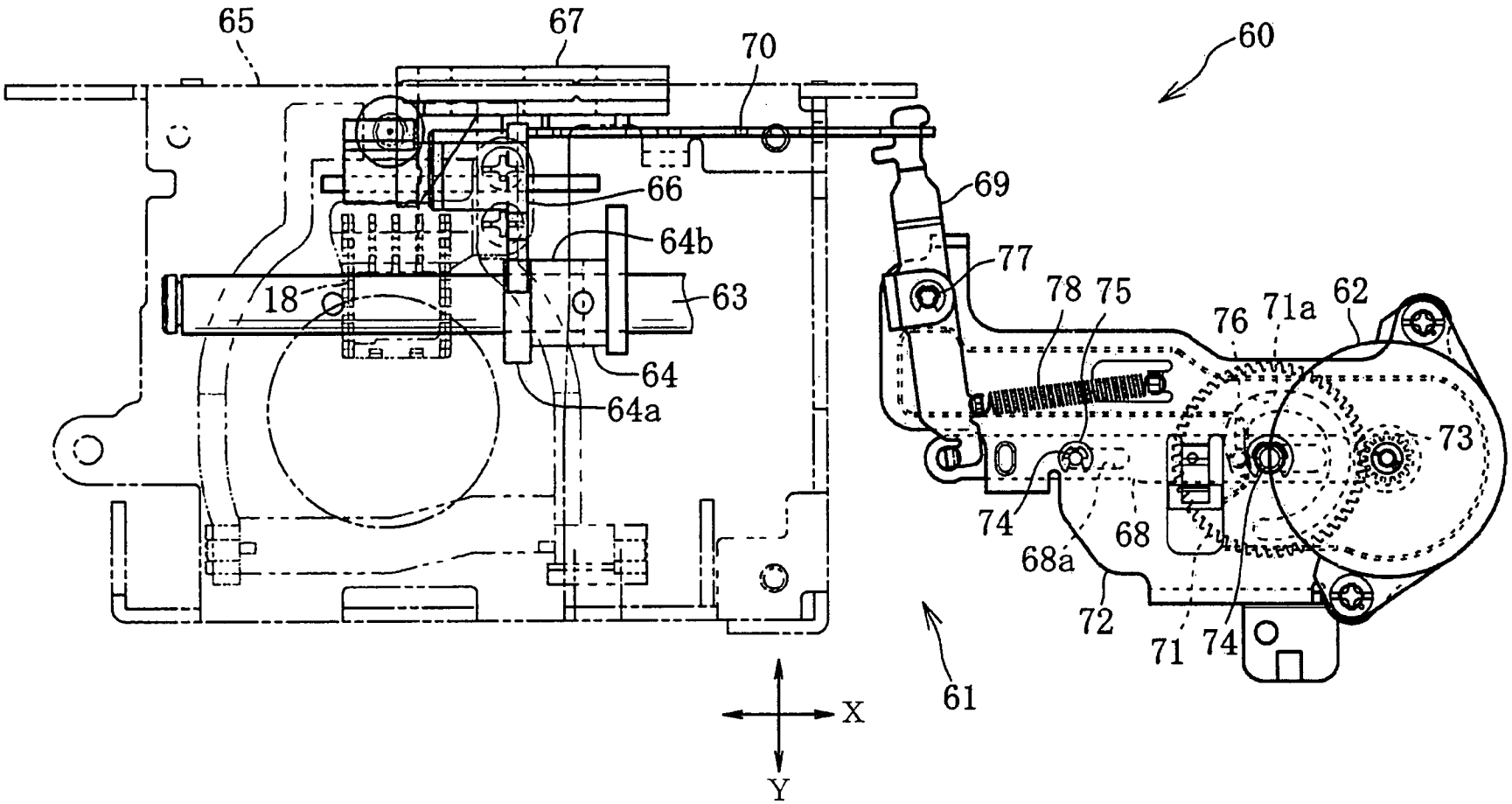
FIG. 7 is a top view of a fee dog vertically moving mechanism and a feed dog switching mechanism with the feed dog in active state.
Figure 8:
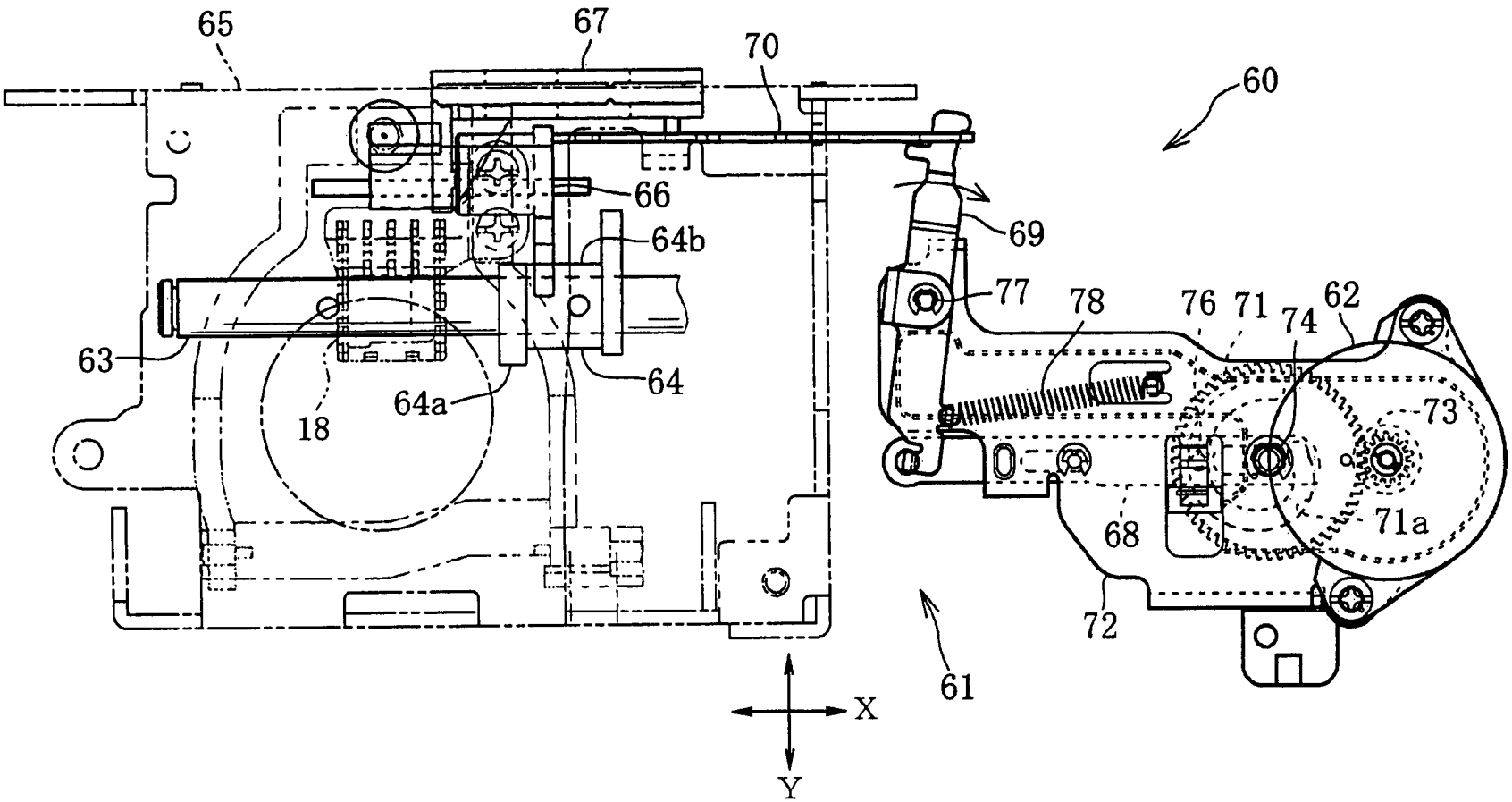
FIG. 8 is a is a top view of a fee dog vertically moving mechanism and a feed dog switching mechanism with the feed dog in an inactive state.

Referring to FIGS. 7 and 8, feed dog switching unit 60 includes a feed dog switching mechanism 61 that switches feed dog 18 between an active state and an inactive state, and a feed dog lowering step motor 62 that drives feed dog switching mechanism 61. Lower shaft 63 described earlier has a vertical feed cam 64 secured to it. Vertical feed cam 64 has an eccentric cam 64*a* on its left end side, and a cylindrical portion 64*b* on its right side.

Though only briefly described, feed dog 18 in active state is moved above and below needle plate 1*a* in synchronism with the rotation of lower shaft 63 when vertical feed contact 66 is in engagement with eccentric cam 64*a* of vertical feed cam 64 as can be seen in FIG. 7. As opposed to this, as can be seen in FIG. 8, when vertical feed contact 66 is oriented rightward from the state described in FIG. 7 to establish engagement with cylindrical portion 64*b*, feed dog 18 is stays lowered below needle plate 1*a* in inactive state.

Feed dog switching mechanism 61 includes components such as a contact transfer element 67 for transferring vertical feed contact 66, a second slide lever 70 for laterally transferring contact transfer element 67, a swing lever 69 for transferring second slide lever 70, a first slide lever 68 for swinging swing lever 69, and a follower gear 71 for transferring first slide lever 68. Contact transfer element 67 is fitted down into a plated portion provided at a rear end portion of feed unit frame 65 configured by assembly of components such as feed dog 18 and is guided laterally movably by the plated portion.

Feed unit frame 65 has a drop unit frame 72 provided to its immediate right side. At the right end of drop unit frame 72, a feed dog lowering step motor 62 is secured so as to be oriented downward. Drop unit frame 72 further rotatably supports follower gear 71 and has first slide lever 68 and swing lever 69 mounted on it. Feed dog lowering step motor 62 has a drive gear 73 secured on its drive shaft which is in mesh with follower gear 71. On the upper surface of follower gear 71, a helical groove cam 71*a*

First slide lever 68 has a pair of left and right long holes 68*a* defined on it through which a pair of left and right first support pins 74 is respectively passed. The upper ends of first support pins 74 are secured on the upper side of drop unit frame 72, and stop rings 75 are provided on the under side of drop unit frame 72 to allow first slide lever 68 to slide in the lateral direction. First slide lever 68 further has an engagement pin 76 secured on its right end that is engaged with helical groove cam 71*a* of follower gear 71 from above.

On the left end portion of drop unit frame 72, on the other hand, a longitudinally extending swing lever 69 is supported swingably by a second support pin 77 provided at its lengthwise mid portion. The left end of first slide lever 68 is connected to the front end of swing lever 69. The rear end of swing lever 69 is connected to the right end of second slide lever 70 which is connected to contact transfer element 67.

Between the front end proximity of swing lever 69 and drop unit frame 72, an extension coil spring 78 is engaged for eliminating noise originating from play in connection or engagement between helical groove cam 71*a* and engagement pin 76; first slide lever 68, swing lever 69 and second slide lever 70; and between second slide lever 70 and contact transfer element 67, respectively.

Feed dog lowering step motor 62 is controlled by controller 91. As can be seen in FIG. 7, when feed dog lowering step motor 62 is rotated counterclockwise (also referred to as reverse rotation) follower gear 71 is rotated clockwise and first slide lever 68 is moved rightward via engagement pin 76 engaged with helical groove cam 71*a*. Thus, swing lever 69 is swung counterclockwise consequently moving contact transfer element 67 leftward via second slide lever 70 causing vertical feed contact 66 to be moved from cylindrical portion 64*b* to eccentric cam 64*a* to switch feed dog 18 to the active state allowing vertical movement.

As can be seen in FIG. 8, when feed dog lowering step motor 62 is rotated counterclockwise (also referred to as positive rotation) follower gear 71 is rotated clockwise in top view and first slide lever 68 is moved leftward via engagement pin 76 engaged with helical groove cam 71*a*. Thus, swing lever 69 is swung clockwise consequently moving contact transfer element 67 rightward via second slide lever 70 causing vertical feed contact 66 to be moved from eccentric cam 64*a* cylindrical portion 64*b* to switch feed dog 18 to the inactive state staying below needle plate 1*a* without vertical movement.

Next, a description will be given on a control system of sewing machine M.

Figure 9:
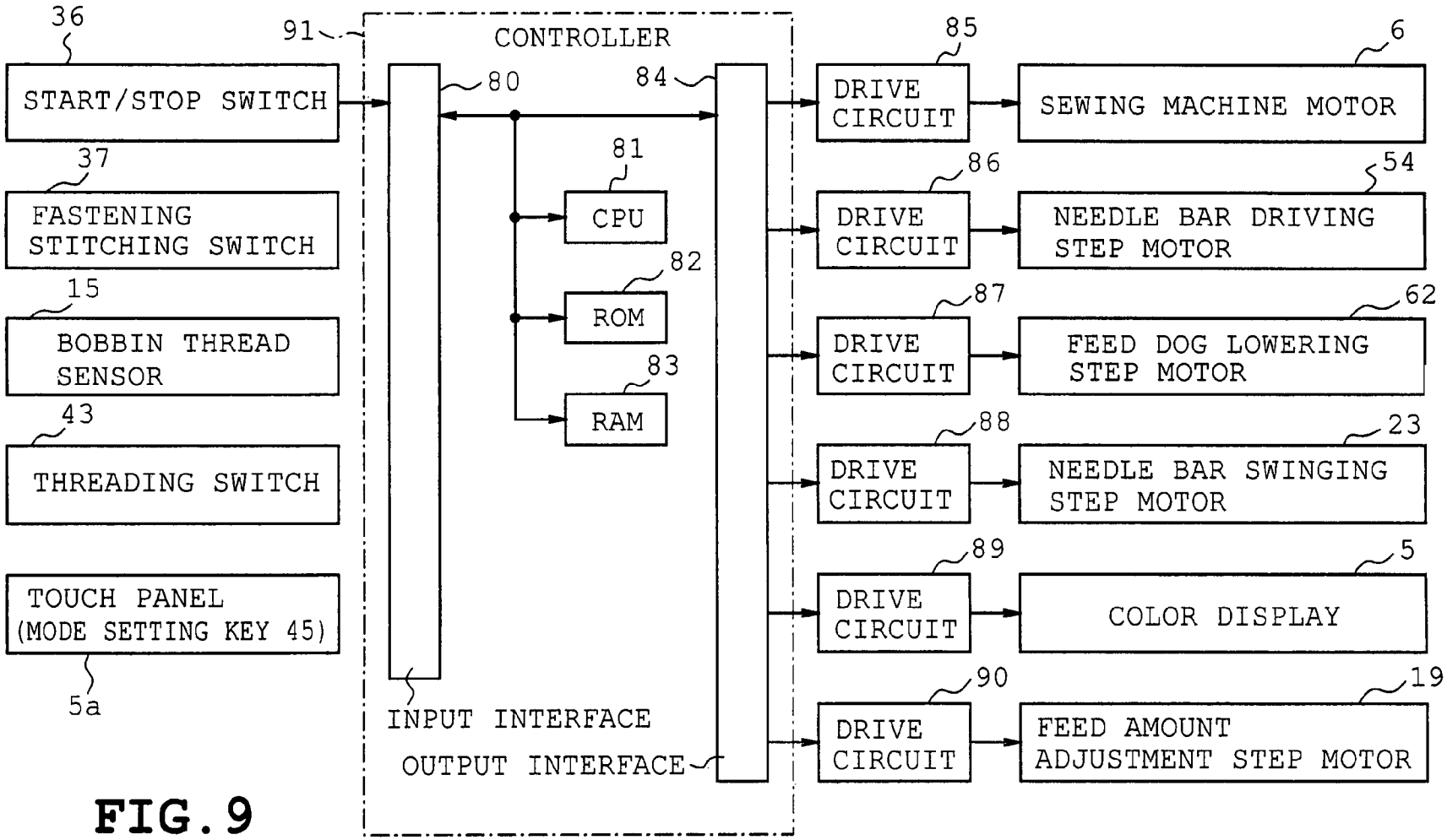
FIG. 9 is a block diagram indicating a control system of the sewing machine.

Referring to FIG. 9, controller 91 configured primarily by a microcomputer and includes components such as a CPU 81, a ROM 82, a RAM 83, an input interface 80 and an output interface 84 interconnected by data bus, or the like.

Input interface 80 establishes connections with components such as start/stop switch 36, fastening stitching switch 37, bobbin thread sensor 15, threading switch 43, and touch panel 5*a*. Output interface 84, on the other hand, establishes connections with components such as a sewing machine motor 6, presser bar driving step motor 54, feed dog lowering step motor 62, needle bar swinging step motor 23, color display 5, and feed amount adjustment step motor 19 through drive circuits 85 to 89.

ROM 82 pre-stores control programs such as a control program for executing normal sewing operation, a control program for executing embroidery sewing operation based on embroidery data, a display control program for displaying various types of information on color display 5, a determination program for determining whether or not to execute fastening stitching, and a fastening stitch process control program, for executing fastening stitching process on the workpiece cloth during the free motion sewing mode. As later detailed in the operational description given with reference to a flowchart, execution of fastening stitch processing program allows control of presser bar vertically moving unit 50 (presser bar driving step motor 54), feed dog switching unit 60 (feed dog lowering step motor 62) and fastening stitching operation during the free motion sewing mode.

ROM 82 pre-stores fastening stitching data for forming predetermined number of fastening stitches on the workpiece cloth. In the present exemplary embodiment, fastening stitching data is configured for execution of fastening stitching by feeding the workpiece cloth longitudinally with feed dog 18 in a predetermined stitch pitch of approximately 0.2 mm, for example, in a predetermined number of stitches (3 or 4 stitches, for example).

Controller 91 executes fastening stitch processing program during the free motion sewing mode to execute the following controls. When mode switching is made to free motion sewing mode from other sewing modes, feed dog switching unit 60 is operated in response to the incoming instruction signal from start/stop switch 36 or fastening stitch 37 to switch feed dog 18 to the active state as well as controlling presser bar vertically moving unit 50 to press the workpiece by presser foot 10. Then, feed dog driving unit is controlled based on fastening stitching data stored in ROM 82 to execute fastening stitching.

ROM 82 allocates fastening stitching data memory which pre-stores fastening stitching data and when executing a sewing operation with sewing machine M, sewing data of the selected sewing pattern and the stitching data are read from ROM 82 and stored in data memory of RAM 83. RAM 83 allocates data memory for storing sewing data to be sewn which has been read from ROM 82 and various other work memory.

Figure 10:
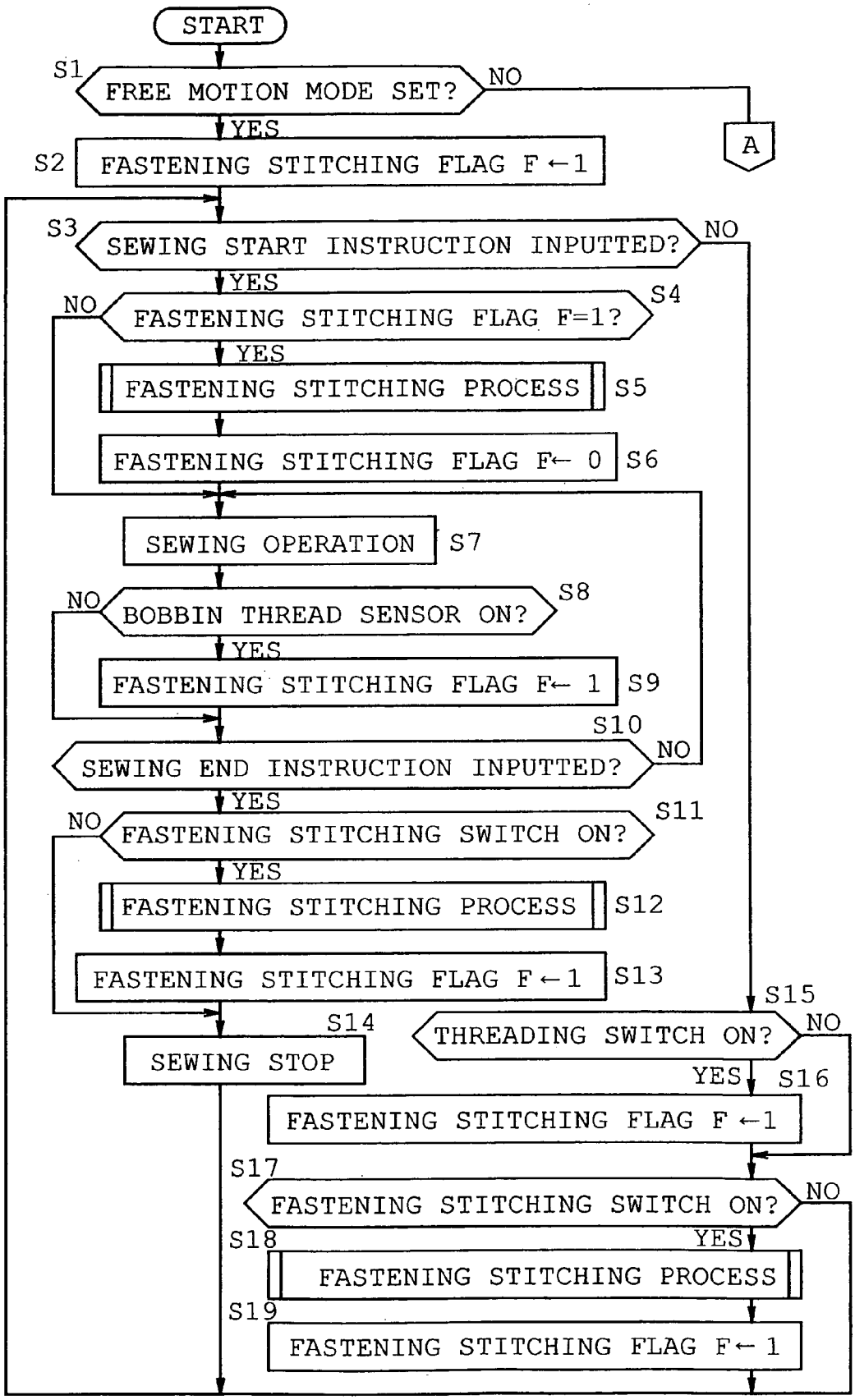
FIG. 10 is a flowchart describing a control flow of sewing machine control executed by a controller.
Figure 11:
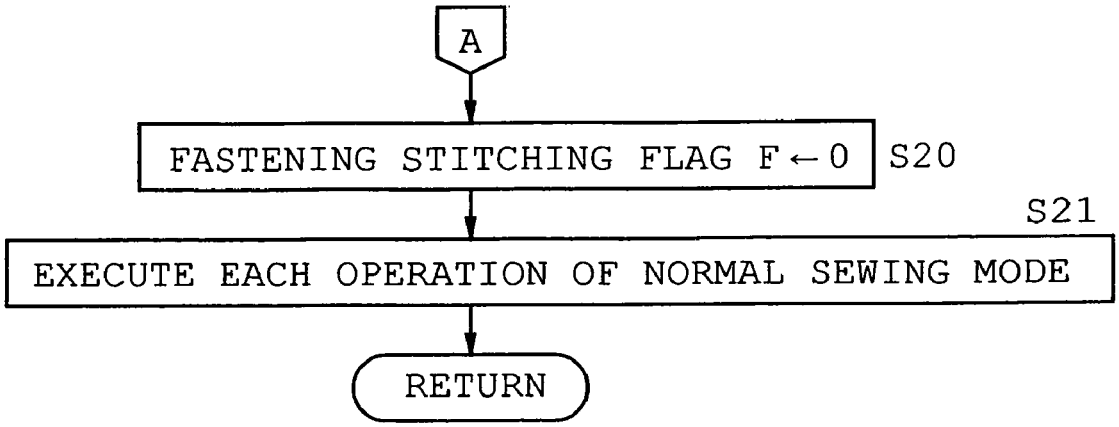
FIG. 11 is another flowchart describing a control flow of sewing machine control executed by the controller.

Next, a description will be given on the operation of the above described configuration based on FIGS. 10 and 11. Reference symbols Si (i=1,2 . . . ) indicate each step of the control flow.

Controller 91 starts the determination control when power of sewing machine M is turned ON. As the first step of the control, controller 91 determines whether or not the free motion sewing mode has been set by mode setting key 45 (S1), if free motion sewing mode has been set (S1: Yes), controller 91 sets fastening stitch flag F stored in RAM 83 to 1 (S2). If free motion sewing mode has not been set, in other words, if normal sewing mode is set (S1: No), the control flow proceeds to FIG. 11 where fastening stitch flag F is set to 0 (S20) and each operation of normal sewing mode is executed (S21). The control flow then, returns to S1.

Instead of switching the mode setting to the free motion sewing mode by operation of mode setting key 45, mode switching to the free motion sewing mode may be made by selecting a free motion pattern from a pattern selection screen. Instead of providing mode setting key 45 as a touch key operated from touch panel 5*a* displayed on color display 5, a dedicated switch may be provided independently.

Then, at step S3, controller 91 determines whether or not start of sewing operation has been instructed by start/stop switch 36, and if start of sewing operation has been instructed (S3: Yes), controller 91 determines whether or not fastening stitch flag F is set to 1 (S4). In other words, a determination is made as to whether or not execution of fastening stitching is possible. If 1 has been set to fastening stitch flag F (S4: Yes), controller 91 executes fastening stitching process (S5) which will be described in detail afterwards. After setting the fastening stitching flag F to 0 (S6), sewing operation is executed (S7). If 0 has been set to fastening stitch flag F, (S4: No), control flow proceeds to S7. In the free motion sewing mode, sewing operation is carried out while the workpiece cloth is manually moved freely by the user with feed dog 18 in the inactive state below needle plate 1*a*.

Next, when bobbin thread sensor 15 is turned ON due to lack of remaining bobbin thread T wound on bobbin thread bobbin 13, (S8: Yes), controller 91 sets fastening stitch flag F to 1 (S9). Then, controller 91 determines whether or not a sewing end instruction has been inputted, in other words, whether or not sewing end has been instructed by start/stop switch 36 (S10). If sewing end has been instructed (S10: Yes), controller 91 determines whether or not fastening stitch switch 37 has been turned ON (S11). If sewing end has not been instructed (S10: No), control flow proceeds to S7 to continue the sewing operation.

By turning ON fastening stitching switch 37 (S11: Yes), fastening stitching process is executed (S12) and after controller 91 sets fastening stitching flag F to 1 (S13) sewing operation is stopped (s14). The control flow thereafter proceeds to S3. Meanwhile, the user is allowed to replace bobbin thread bobbin 13.

If sewing start has not been instructed (S3: No), controller 91 determines whether or not threading switch 43 has been turned ON, in other words, whether or not the user has threaded the eye of sewing needle 8 (S15). If sewing needle 8 has been threaded (S15: Yes), after setting fastening stitching flag F to 1 (S16), controller 91 determines whether or not fastening stitching switch 37 has been turned ON (S17). If fastening stitching switch 37 has been turned ON (S17: Yes), controller 91 executes fastening stitching process (S18) whereafter fastening stitch flag F is set to 1 (S19), and the control flow proceeds to S3. If fastening stitching switch 37 has not been turned ON (S17: NO), the control flow proceeds to S3. However, if threading operation has not been executed (S15: No), the control flow proceeds to S17.

According to the above described process, controller 91, when determining that the subsequent operational state is the start of a sewing sequence, sets flag F to 1. More specifically, when any one of the following conditions are met, the subsequent operational state is determined as the start of a sewing operation and flag F is set to 1: (a) mode switching is made from the normal sewing mode to the free motion sewing mode; (b) execution of threading operation is detected through threading switch 43; (c) lack of remaining thread amount of bobbin thread T is detected by bobbin thread sensor 15; and (d) fastening stitching switch 37 is turned ON to execute a fastening stitch operation at the end sewing sequence performed on workpiece cloth. When sewing start is instructed by start stop switch 36, fastening stitching operation is executed under the condition that the subsequent operational state of the sewing machine is determined as the start of a sewing sequence, in other words, when flag F is set to 1.

Figure 12:
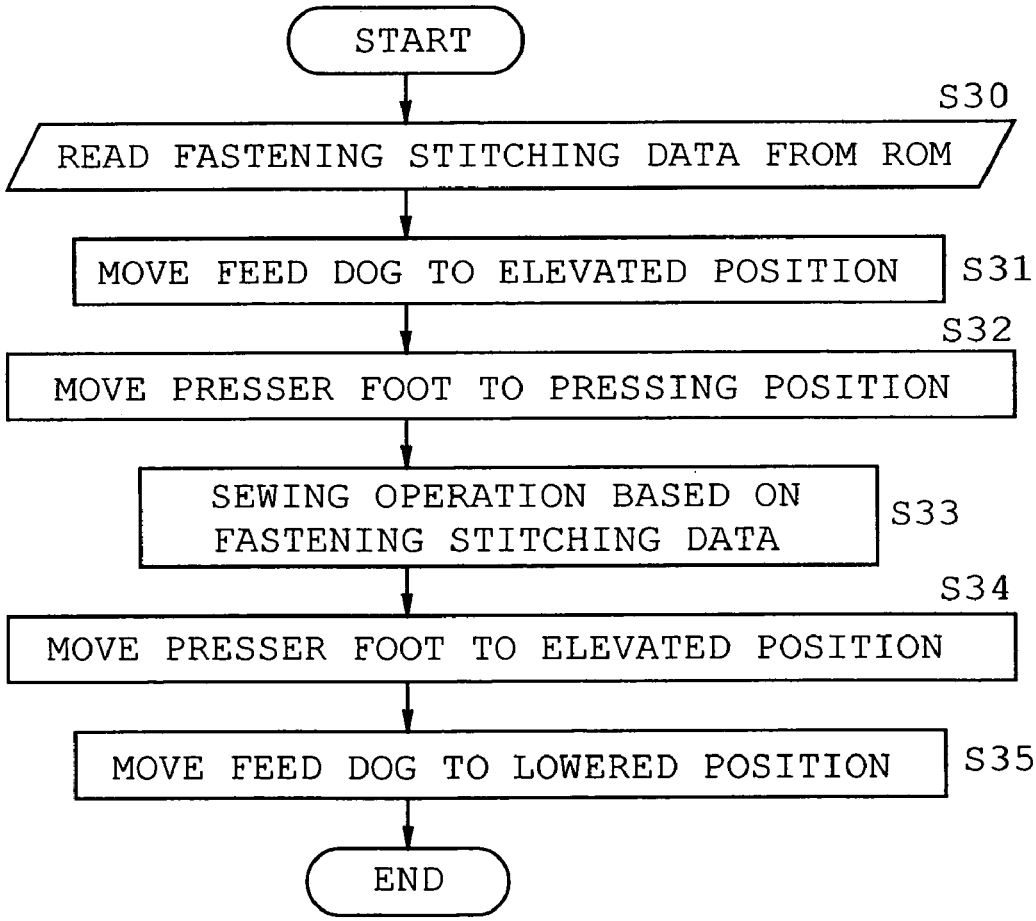
FIG. 12 is a flowchart describing a control flow of fastening stitching.

Referring to the flowchart indicated in FIG. 12, a description will be given in more detail on fastening stitching process executed by controller 91 represented as steps S5, S12 and S19 in the flowchart indicated in FIG. 10. Reference symbols Si (i=30, 31 . . . ) indicate each step of the control flow.

As the first step of fastening stitch processing control, controller 91 reads the fastening stitching data from ROM 82 (S30) and elevates feed dog 18 to active state by feed dog lowering step motor 62 (S31). Controller 91 also lowers presser bar 11 by presser bar drive step motor 54 to move presser foot 10 to the pressing position in which the workpiece cloth is pressed by presser foot 10 (S32).

Next, controller 91 controls feed dog driving unit to execute the sewing operation (fastening stitching) based on the fastening stitching data read (S33). As described earlier, fastening stitch operation is executed by feeding the workpiece cloth longitudinally with feed dog 18 in a predetermined small stitch pitch of approximately 0.2 mm, for example, in a predetermined number of stitches (3 or 4 stitches, for example). The stitch pitch and the number of stitches may be changed as required.

Upon completion of fastening stitching, controller 91 elevates presser bar 11 to place presser foot 10 in the elevated position (S34) by presser bar driving step motor 54. Then, controller 91 lowers feed dog 18 by feed dog lowering step motor 62 to the lowered position in the inactive state (S35) to terminate the process.

Next, a description will be given on the operation and effect of the above described sewing machine M.

In the free motion sewing mode, upon receiving instructions from start/stop switch 36 to execute fastening stitching at sewing start, feed dog switching unit 60 switches feed dog 18 to the active state. Then, presser bar vertically moving unit 50 lowers presser foot 10 to press the workpiece cloth and controller 91 controls feed dog driving unit based on the fastening stitching data to execute fastening stitching. Thus, fastening stitches are formed automatically at the beginning of pattern sewing sequence on the workpiece cloth.

On the other hand, upon receiving instructions from fastening stitching switch 37 to execute fastening stitching, feed dog switching unit 60 switches feed dog 18 to active state and presser bar vertically moving unit 50 lowers presser foot 10 to press the workpiece cloth. Then, controller 91 controls feed dog driving unit based on the fastening stitching data to execute fastening stitching. Thus, fastening stitches are formed automatically at the end of pattern sewing sequence on the workpiece cloth.

As described above, fastening stitches can be formed automatically at the beginning and the end of pattern sewing sequence during the free motion sewing operation. Since the user is no longer required to manually feed the workpiece cloth in small subtle amounts, even an inexperienced user will be successful in forming fastening stitches. Since the present exemplary embodiment further allows the workpiece cloth to be reliably pressed by presser foot 10 during fastening stitching, the workpiece cloth can be fed reliably by feed dog 18 during fastening stitching. The above described configuration moreover does not reduce the level of work efficiency since presser foot 10 need not be manually lowered by the user.

In the present exemplary embodiment, controller 91 determines whether or not the subsequent operational state is the start of sewing sequence by verifying that flag F is set to 1, and executes fastening stitching in accordance with incoming instruction signal from start/stop switch 36. Thus, fastening stitches can be formed reliably at the beginning of pattern sewing sequence while preventing formation of unnecessary fastening stitches. Since controller 91 monitors the operational status of sewing machine M such as status of bobbin thread bobbin 13 replacement and threading of the eye of sewing needle 8 to determine whether the subsequent operational state is the start of a sewing sequence when at least one of the aforementioned requirements is met, unnecessary formation of fastening stitches can be prevented reliably.

Further, since feed dog switching unit 60 is configured by feed switching mechanism 61 and feed dog lowering step motor 62 which drives feed dog switching mechanism 61, and presser bar vertically moving unit 50 is configured by presser bar vertically moving mechanism 51 and presser bar driving step motor 54, feed dog 18 can be switched between the active and inactive state, and presser foot 10 can be vertically moved with a simple configuration.

A description will now be given on partial modifications of the above exemplary embodiment.

Fastening stitching being executed by feeding the workpiece cloth by feed dog 18 in small predetermined pitches in the above described exemplary embodiment may be modified such that fastening stitching is executed by laterally swinging needle bar 9 by a needle bar swinging unit 20 without having to move the workpiece cloth. The above modification requires the fastening stitching process control executed by controller 91 and fastening stitching data stored in ROM 82 to be modified.

Figure 13:
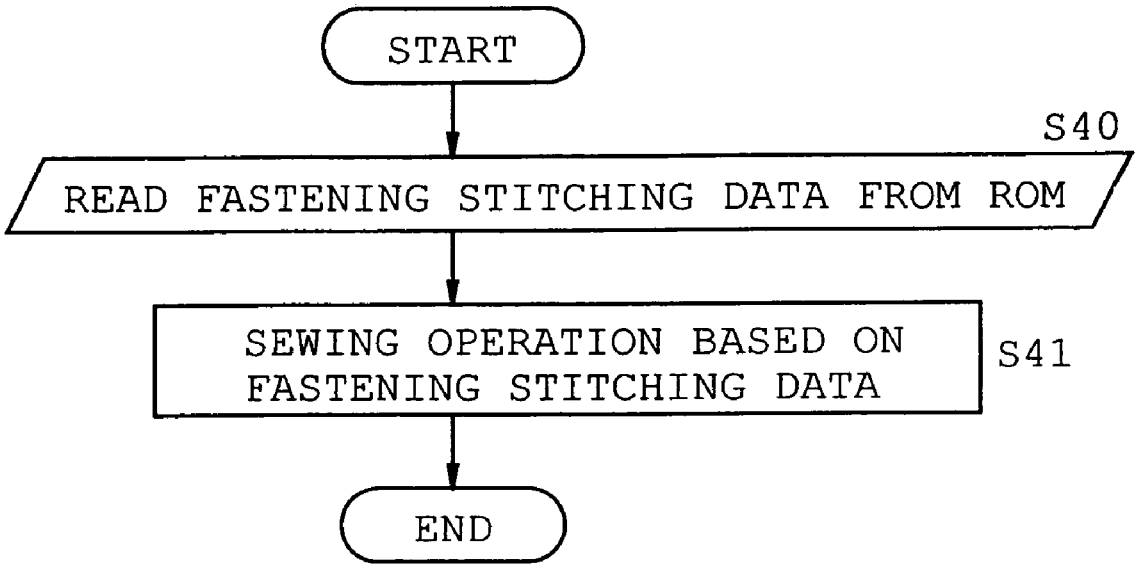
FIG. 13 corresponds to FIG. 12 according a modified exemplary embodiment.

More specifically, the fastening stitching data stored in ROM 82 will now store data for forming fastening stitches of predetermined number of stitches (3 or 4 stitches, for example) while laterally swinging needle bar 11 by a predetermined pitch (0.2 mm, for example). Flowchart indicated in FIG. 13 describes a control flow of a modified fastening stitching processing control executed by controller 91. When the fastening stitching process is started, the fastening stitching data is read from ROM 82 (S40) and needle bar 9 is laterally swung by a needle bar swinging step motor 23 driven based on the fastening stitching data to execute the sewing operation (S41).

According to the above described configuration, the user is not required to manually feed the workpiece cloth in small subtle amounts, and thus, even an inexperienced user will be successful in forming fastening stitches. Moreover, since fastening stitches can be formed by the swinging of needle bar 11 without having to feed the workpiece cloth, the user is no longer required to switch feed dog 18 from the inactive state to the active state and the control executed by controller 91 can be simplified.

Execution of fastening stitching at the beginning and the end of a sewing sequence may be instructed by a foot controller instead of a start/stop switch 36.

Functionality of fastening stitching switch 37 may be incorporated into reverse stitching switch 46 such that when reverse stitching switch 46 is turned ON, fastening stitching for reverse stitching may be executed.

Functionality of fastening stitching switch 37 may be incorporated into thread cutting switch 47 such that when thread cutting switch 47 is turned ON, thread cutting operation is executed after fastening stitches have been formed.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine including a sewing machine bed, a needle plate provided on the sewing machine bed, a feed dog provided in the sewing machine bed below the needle plate, a needle bar, and a sewing needle attached to the lower end of the needle bar, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated in a lowered position below the needle plate to allow the workpiece cloth to be manually fed, the sewing machine comprising:

a feed dog driver that drives the feed dog longitudinally and vertically;

a feed dog switcher that activates and inactivates the feed dog;

a first instruction issuer that instructs execution of fastening stitching at a beginning of pattern sewing sequence;

a second instruction issuer that instructs execution of fastening stitching at an end of pattern sewing sequence;

a fastening stitching data storage that stores fastening stitching data for executing fastening stitching on the workpiece cloth being fed longitudinally by the feed dog; and a controller that, when in the free motion sewing mode, activates the feed dog by the feed dog switcher in response to an incoming instruction signal from the first instruction issuer or the second instruction issuer to execute fastening stitching through control of feed dog driver based on the fastening stitching data.

2. The sewing machine according to claim 1, further comprising a presser bar provided with a presser foot that presses the workpiece cloth against the needle plate, and a presser bar vertically moving element that vertically moves the presser bar, wherein the controller controls the presser bar vertically moving element to press the presser foot against the needle plate when executing fastening stitching in response to the incoming instruction signal from the first instruction issuer or the second instruction issuer.

3. The sewing machine according to claim 1, further comprising a determiner that determines whether or not a subsequent operational state is a start of sewing sequence, wherein the controller, when the start of sewing sequence is determined as the subsequent operational state by the determiner, executes fastening stitching in response to the incoming instruction signal from the first instruction issuer.

4. The sewing machine according to claim 3, further comprising a threading switch that determines whether or not an eye of the sewing needle has been threaded, and a bobbin thread sensor that detects remaining bobbin thread amount, wherein the determiner determines that the subsequent operational state is the start of sewing sequence when encountering either of a mode switching from the normal sewing mode to the free motion sewing mode, a detection of threading operation by the threading switch, a detection of lack of remaining bobbin thread amount by the bobbin thread sensor, and an execution of fastening stitching at the end of pattern sewing sequence of the workpiece cloth based on incoming instruction signal from the second instruction issuer.

5. A sewing machine including a sewing machine bed, a needle plate provided on the sewing machine bed, a feed dog provided in the sewing machine bed below the needle plate, a needle bar, and a sewing needle attached to the lower end of the needle bar, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated in a lowered position below the needle plate to allow the workpiece cloth to be manually fed, the sewing machine comprising:

a needle bar swinger that laterally swings the needle bar;

a feed dog switcher that activates and inactivates the feed dog;

a first instruction issuer that instructs execution of fastening stitching at a beginning of pattern sewing sequence;

a second instruction issuer that instructs execution of fasting stitching at an end of pattern sewing sequence;

a fastening stitching data storage that stores fastening stitching data for executing fastening stitching on the workpiece cloth by laterally swinging the needle bar; and a controller that, when in the free motion sewing mode, executes fastening stitching in response to an incoming instruction signal from the first instruction issuer or the second instruction issuer to execute fastening stitching through control of needle bar swinger based on the fastening stitching data.

6. The sewing machine according to claim 5, further comprising a presser bar provided with a presser foot that presses the workpiece cloth against the needle plate, and a presser bar vertically moving element that vertically moves the presser bar, wherein the controller controls the presser bar vertically moving element to press the presser foot against the needle plate when executing fastening stitching in response to the incoming instruction signal from the first instruction issuer or the second instruction issuer.

7. The sewing machine according to claim 5, further comprising a determiner that determines whether or not a subsequent operational state is a start of sewing sequence, wherein the controller, when the start of sewing sequence is determined as the subsequent operational state by the determiner, executes fastening stitching in response to the incoming instruction signal from the first instruction issuer.

8. The sewing machine according to claim 7, further comprising a threading switch that determines whether or not an eye of the sewing needle has been threaded, and a bobbin thread sensor that detects remaining bobbin thread amount, wherein the determiner determines that the subsequent operational state is the start of sewing sequence when encountering either of a mode switching from the normal sewing mode to the free motion sewing mode, a detection of threading operation by the threading switch, a detection of lack of remaining bobbin thread amount by the bobbin thread sensor, and an execution of fastening stitching at the end of pattern sewing sequence of the workpiece cloth based on incoming instruction signal from the second instruction issuer.

9. A non-transitory computer readable medium storing a fastening stitching processing program for use in a sewing machine including a sewing machine bed, a needle plate provided on the sewing machine bed, a feed dog provided in the sewing machine bed below the needle plate, a feed dog driver that drives the feed dog longitudinally and vertically, a feed dog switcher that activates and inactivates the feed dog, a needle bar, and a sewing needle attached to the lower end of the needle bar, a first instruction issuer that instructs execution of fastening stitching at a beginning of pattern sewing sequence, a second instruction issuer that instructs execution of fasting stitching at an end of pattern sewing sequence, a fastening stitching data storage that stores fastening stitching data for executing fastening stitching on the workpiece cloth being fed longitudinally by the feed dog, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated to allow the workpiece to be manually fed, the fastening stitching processing program, comprising:

instructions for activating the feed dog by the feed dog switcher in response to an incoming instruction signal from the first instruction issuer or the second instruction issuer; and instructions for executing fastening stitching through control of feed dog driver based on the fastening stitching data.

10. The computer readable medium storing the fastening stitching processing program according to claim 9, for use in the sewing machine further comprising a presser bar provided with a presser foot that presses the workpiece cloth against the needle plate, and a presser bar vertically moving element that vertically moves the presser bar, wherein the fastening stitching processing program further comprises instructions for controlling the presser bar vertically moving element to press the presser foot against the needle plate when executing fastening stitching in response to the incoming instruction signal from the first instruction issuer or the second instruction issuer.

11. The computer readable medium storing the fastening stitching processing program for use in the sewing machine according to claim 9, further comprising instructions for determining whether or not a subsequent operational state is a start of sewing sequence, wherein the instructions for executing fastening stitching instructs execution of fastening stitching in response to the incoming instruction signal from the first instruction issuer when the start of sewing sequence is determined as the subsequent operational state.

12. The computer readable medium storing the fastening stitching processing program according to claim 11, for use in the sewing machine further comprising a threading switch that determines whether or not an eye of the sewing needle has been threaded, and a bobbin thread sensor that detects remaining bobbin thread amount, wherein the start of sewing sequence is determined as the subsequent operational state when encountering either of a mode switching from the normal sewing mode to the free motion sewing mode, a detection of threading operation by the threading switch, a detection of lack of remaining bobbin thread amount by the bobbin thread sensor, and an execution of fastening stitching at the end of pattern sewing sequence of the workpiece cloth in response to the incoming instruction signal from the second instruction issuer.

13. A non-transitory computer readable medium storing a fastening stitching processing program for use in a sewing machine including a sewing machine bed, a needle plate provided on the sewing machine bed, a feed dog provided in the sewing machine bed below the needle plate, a feed dog switcher that activates and inactivates the feed dog, a needle bar, a sewing needle attached to the lower end of the needle bar, a needle bar swinger that laterally swings the needle bar, a first instruction issuer that instructs execution of fastening stitching at a beginning of pattern sewing sequence, a second instruction issuer that instructs execution of fasting stitching at an end of pattern sewing sequence, the sewing machine being capable of mode switching between a normal sewing mode in which the feed dog is activated to move above and below the needle plate to feed a workpiece cloth longitudinally in synchronism with a vertical movement of the needle bar, and a free motion sewing mode in which the feed dog is inactivated to allow the workpiece cloth to be manually fed, the fastening stitching processing program, comprising:

instructions for executing fastening stitching, when in the free motion sewing mode, through control of the needle bar swinger based on the fastening stitching data, in response to the incoming instruction signal from the first instruction issuer or the second instruction issuer.

14. The computer readable medium storing the fastening stitching processing program according to claim 13, for use in the sewing machine further comprising a presser bar provided with a presser foot that presses the workpiece cloth against the needle plate, and a presser bar vertically moving element that vertically moves the presser bar, wherein the fastening stitching processing program further comprises instructions for controlling the presser bar vertically moving element to press the presser foot against the needle plate when executing fastening stitching in response to the incoming instruction signal from the first instruction issuer or the second instruction issuer.

15. The computer readable medium storing the fastening stitching processing program for use in the sewing machine according to claim 13, further comprising instructions for determining whether or not a subsequent operational state is a start of sewing sequence, wherein the instructions for executing fastening stitching instructs execution of fastening stitching in response to the incoming instruction signal from the first instruction issuer when the start of sewing sequence is determined as the subsequent operational state.

16. The computer readable medium storing the fastening stitching processing program according to claim 15, for use in the sewing machine further comprising a threading switch that determines whether or not an eye of the sewing needle has been threaded, and a bobbin thread sensor that detects remaining bobbin thread amount, wherein the start of sewing sequence is determined as the subsequent operational state when encountering either of a mode switching from the normal sewing mode to the free motion sewing mode, a detection of threading operation by the threading switch, a detection of lack of remaining bobbin thread amount by the bobbin thread sensor, and an execution of fastening stitching at the end of pattern sewing sequence of the workpiece cloth in response to the incoming instruction signal from the second instruction issuer.

* * * * *